US005342244A

United States Patent [19]

Nelson

[11] Patent Number: 5,342,244

[45] Date of Patent: Aug. 30, 1994

[54] HUMAN-POWERED GYROSCOPE

[76] Inventor: Kevin R. Nelson, 1615 E. 2nd St., North Platte, Nebr. 69101

[21] Appl. No.: 2,187

[22] Filed: Jan. 8, 1993

[51] Int. Cl.[5] ..... A63G 1/12

[52] U.S. Cl. ..... 472/14; 472/17; 482/146

[58] Field of Search ..... 472/14, 16, 17, 18, 472/26, 30; 482/146, 78; 434/55

[56] References Cited

U.S. PATENT DOCUMENTS

| | | | |
|---|---|---|---|
| 846,925 | 3/1907 | Kramer . | |
| 1,342,871 | 6/1920 | Ruggles . | |
| 3,141,669 | 7/1964 | Chul | 272/33 |
| 3,164,382 | 1/1965 | Johnson | 272/33 |
| 3,276,777 | 10/1966 | Pruitt, Sr. | 272/33 |
| 4,402,500 | 9/1983 | Coles | 272/33 |
| 4,799,667 | 1/1989 | Suchy | 272/36 |
| 4,824,099 | 4/1989 | Rusu et al. | 272/33 |
| 5,046,721 | 9/1991 | Altare | 272/36 |

*Primary Examiner*—Carl D. Friedman

*Assistant Examiner*—Kien Nguyen

*Attorney, Agent, or Firm*—Senniger, Powers, Leavitt & Roedel

[57] ABSTRACT

A human-powered gyroscope comprising a frame for supporting the gyroscope, a ring assembly and a riding station for supporting a human rider on the ring assembly. The ring assembly includes an inner ring, an intermediate ring and an outer ring concentrically disposed with each other. The outer ring is mounted on the frame for rotation about a first axis extending generally diametrically of the outer ring. The intermediate ring is mounted on the outer ring for rotation relative to the outer ring about a second axis extending generally diametrically of the intermediate ring. The inner ring is mounted on the intermediate ring for rotation relative to the intermediate ring about a third axis of rotation extending generally diametrically of the inner ring. Two of the axes of rotation of the rings are oriented obliquely with respect to the other of said axes of rotation.

18 Claims, 3 Drawing Sheets

HUMAN-POWERED GYROSCOPE

BACKGROUND OF THE INVENTION

This invention relates generally to physical exercise devices and, more particularly, to a gyroscope device to be ridden by a human rider.

Presently existing gyroscopes constructed to be ridden by a human rider include three rings arranged concentrically about a center point. An outer ring is mounted for rotation on a frame, an intermediate ring is mounted for rotation on the outer ring, and an inner ring is mounted on the intermediate ring for rotation. In combination, the three axes of rotation of the rings permit the rider to rotate about any axis passing through the center point.

Examples of such presently existing gyroscopes are shown in U.S. Pat. Nos. 5,046,721 and 4,799,667. In the existing devices, the axes of rotation of the inner ring and the outer ring, when the rings are coplanar and the rider supported on the inner ring is in an upright position, are co-linear and horizontal. The axis of rotation of the intermediate ring is vertical and 90° removed from the axes of rotation of the inner and outer rings. In this position, which will always be the start position of the gyroscope, it is very difficult for the rider to induce rotation about the vertical axis of the intermediate ring. A difficult and uncomfortable twisting motion about the vertical axis (which bisects the rider's body heightwise) is required. Forward bending at the rider's waist produces almost exclusive end-over-end motion of the inner ring, and negligible rotation on the vertical axis of the intermediate ring. It is virtually impossible for the rider to cause the gyroscope to "walk", which is an upright motion useful for giving the rider an aerobic workout. More specifically, walking involves alternatively swinging the sides of the rider's body forward and backward so that the rider moves with a stiff-legged walking motion. As viewed form the side, any point on the rider's body above or below a generally horizontal plane passing through the common center point of the rings travels along a generally figure eight path. However, the existing human-powered gyroscope devices do not readily permit this motion because of the difficulty in causing the intermediate ring to rotate about the vertical axis.

SUMMARY OF THE INVENTION

Among the several objects and features of the present invention may be noted the provision of a human-powered gyroscope which permits a wide range of motion actuated by a comfortable range of motions by the rider; the provision of such a gyroscope which permits rapid change of motion of the rider's body from spinning about a horizontal axis to spinning about a vertical axis; the provision of such a gyroscope which permits the rider to move with a walking motion in an upright position; and the provision of such a gyroscope which is transportable.

Generally, the human-powered gyroscope of the present invention comprises a frame for supporting the gyroscope and a ring assembly which includes an inner ring, an intermediate ring and an outer ring concentrically disposed with each other. The outer ring is mounted on the frame for rotation relative to the frame about a first axis extending generally diametrically of the outer ring. The intermediate ring is mounted on the outer ring for rotation relative to the outer ring about a second axis of rotation extending generally diametrically of the intermediate ring. The inner ring is mounted on the intermediate ring for rotation relative to the intermediate ring about a third axis of rotation extending generally diametrically of the inner ring. Two of the axes of rotation are oriented obliquely with respect to the other axis of rotation. The human-powered gyroscope further comprises means for supporting a human rider on the ring assembly.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 2:
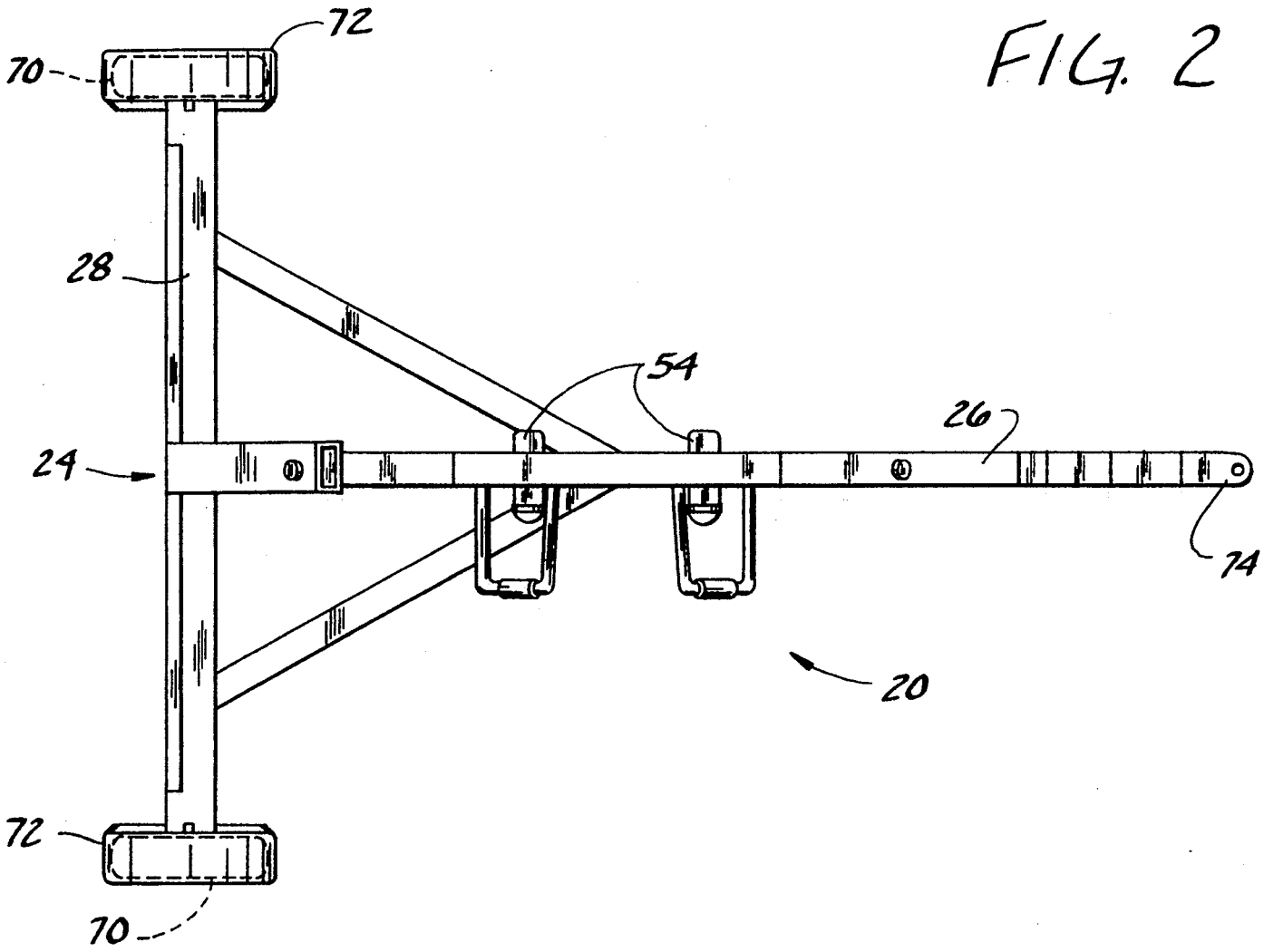
FIG. 2 is a top plan view thereof.

Referring now to the drawings, a human-powered gyroscope constructed according to the principles of this invention is indicated generally at 20. The human-powered gyroscope 20 may be used as a physical exercise apparatus to provide a rider R with a low impact aerobic workout. The human-powered gyroscope 20 comprises a ring assembly, indicated generally at 22, and a frame 24 designed to support the ring assembly. As shown in FIG. 2, the frame 24 includes an elongate central frame member 26 extending under the ring assembly. At the left side of the frame 24, a transverse frame member 28 mounted on the central frame member 26 extends transversely with respect to the central frame member and provides front to back stability for the gyroscope 20. Two support members 29 attached to and extending between the central frame member 26 and the transverse frame member 28 strengthen the frame 24. A first stanchion 30 extends upwardly from the central frame member 26 and includes an inwardly and upwardly projecting upper portion 32. The first stanchion 30 is strengthened by a first brace 34 attached to the central frame member 26 and the first stanchion. The frame 24 is further strengthened by two reinforcing members 33 attached to and extending between the transverse member 28 and the first stanchion 30. A second stanchion 36 projects upwardly and laterally outwardly from the central frame member 26 and is reinforced by a second brace 38 attached to the central frame member and the second stanchion.

The ring assembly 22 includes an inner ring 40, an intermediate ring 42 and an outer ring 44 concentrically disposed with each other. The outer ring 44 is mounted on the first and second stanchions 30, 36 of the frame 24 by low-friction bearing assemblies 46 for free rotation relative to the frame about a first axis extending generally diametrically of the outer ring, indicated at X. The intermediate ring 42 is mounted on the outer ring 44 with low-friction bearing assemblies 48 for free rotation relative to the outer ring about a second axis Y extending generally diametrically of the intermediate ring. The inner ring 40 is mounted on the intermediate ring 42 with low-friction bearing assemblies 50 for free rotation relative to the intermediate ring about a third axis of rotation Z extending generally diametrically of the inner ring.

Figure 1:
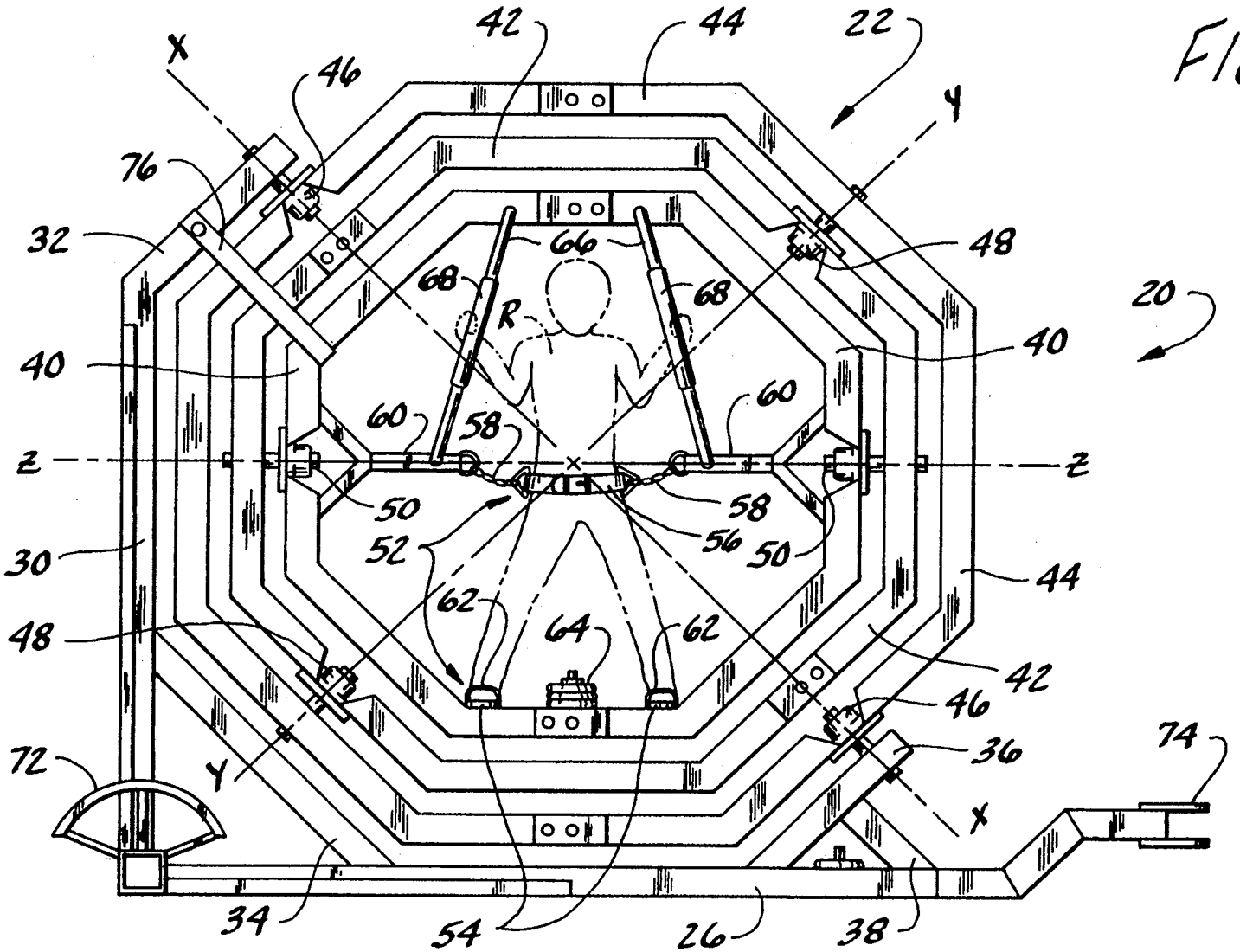
FIG. 1 is a front elevation of the gyroscope showing the rings of the gyroscope in a start position with a rider shown in phantom.

In the illustrated embodiment, the first and second axes of rotation X, Y of the outer ring 44 and the intermediate ring 42, respectively, are oriented obliquely relative to the third axis of rotation Z of the inner ring 40. When the rings 40, 42, 44 are coplanar and the rider R is in an upright position as shown in FIG. 1, the third axis of rotation Z is oriented horizontally, and the first and second axes of rotation X, Y are oriented non-vertically and non-horizontally. It is to be understood that any combination of two axes can be in oblique relation with respect to the other axis and, furthermore, that any one of the several axes of rotation can be horizontal with the other two axes of rotation being oriented non-horizontally and non-vertically and still fall within the scope of this invention.

The human-powered gyroscope 20 further includes means, indicated generally at 52, for supporting a human rider R on the ring assembly 22. The support means 52 comprises a pair of foot stands 54, one for each of the rider's feet, mounted on the inner ring 40. A belt 56 worn around the waist secures the rider R within the inner ring 40 during operation of the gyroscope 20. The belt 56 is flexibly connected by a chain 58 at opposite ends to a respective arm 60 of a pair of arms mounted on and projecting inwardly with respect to the inner ring 40. The flexible chain 58 of the belt 56 permits the rider R to shift the position of his or her torso to effect rotation of the several rings 40, 42, 44. Restraining straps 62 secure the rider's feet to the foot stands 54 during the rotation of the gyroscope 20. The restraining straps 62 include hook and loop fasteners (not shown) for quick attachment and detachment of the straps about the rider's feet, weights 64 attached to the inner ring 40 between the foot stands 56 bias the inner ring in an upright position.

A pair of handlebars 66 attached to the inner ring 40 extend from their connection to the inner ring 40 above the rider R downwardly and laterally outwardly to respective arms 60 to which they are mounted. The handlebars 66 also project outwardly away from the plane of the inner ring 40 in a direction in front of the rider R. The handlebars 66 each have elongated hand grips 68 for grasping by the rider R. The length and position of the hand grips 68 allow persons of different heights to securely hold onto the handlebars 66. The forward and laterally outward location of the handlebars 66 allows the rider R to reach out and grab them with a natural grasping motion and to maintain the arms in a comfortable position below the head during operation. Moreover, the location of the handlebars 66 in front of the operator R places the operator in a position to easily effect rotation of the rings 40, 42, 44 about all of the axes of rotation X, Y, Z.

As shown and described herein, all movement of the rings 40, 42, 44 is driven by power derived from the rider R. However, one or two of the rings may be powered by a machine or another person not riding the ring and still fall within the scope of the present invention.

Figure 3:
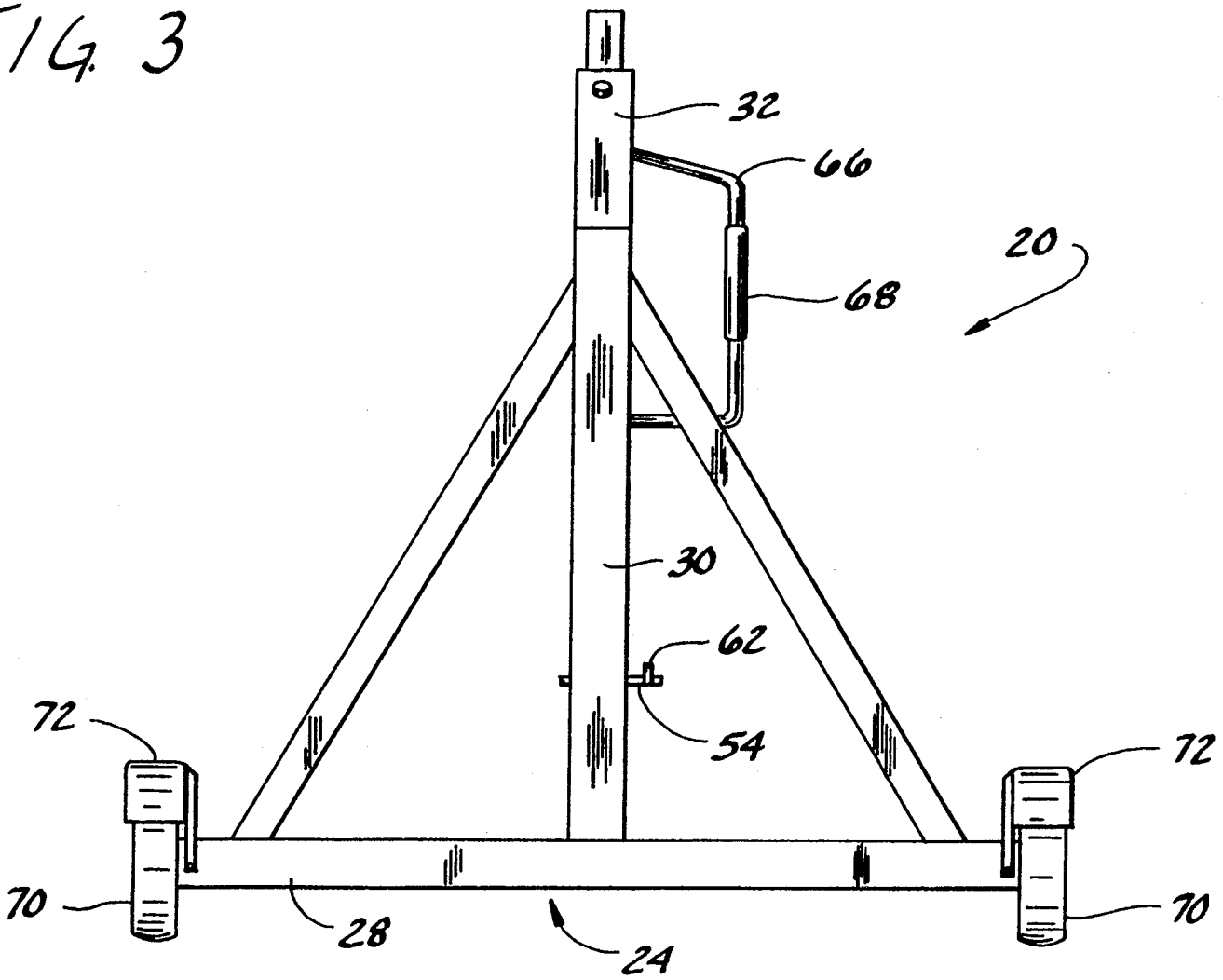
FIG. 3 is a left side elevation thereof.

As shown in FIGS. 2 and 3, wheels 70 may be removably mounted on respective ends of the transverse frame member 28 under fenders 72 mounted at the ends of the transverse member 28. A hitchpost 74 at the end of the central frame 26 opposite the transverse member 28 is provided for attaching the gyroscope 20 to a vehicle (not shown) for transporting it to a desired location. Thus, the device may be easily transported to a particular location and set up for use as an amusement device. The wheels 70 and the hitchpost 74 constitute means for transporting the gyroscope in this embodiment.

In operation, the gyroscope 20, with the wheels 70 attached and the hitchpost 74 connected to a vehicle, is transported to the desired location. At the desired location, the hitchpost 74 is disengaged from the vehicle and the wheels 70 of the gyroscope 20 are removed so that the central frame member 26 and transverse frame member 28 lay on the ground (FIG. 1). In this configuration, the transverse frame member 28 holds the gyroscope 20 from tipping over in a forward or backward direction. The rings 40, 42, 44 of the gyroscope 20 are interlocked in a vertical position with each other by a locking bar 76. The rider R then mounts the gyroscope 20 with his or her feet on the foot stands 54 and fastens his or her feet with the restraining straps 62 and secures them by use of the hook and loop fasteners. The belt 56 is secured around the rider's waist, and the rider R grabs the grips 68 on the handlebars 66 at a comfortable position as shown in FIG. 1. After the rider R is secured within the inner ring 40, the locking bar 76 is moved to the unlocked position and the rider is free to move about the several axes X, Y, Z of the gyroscope 20.

The oblique relation of two of the axes of rotation X, Y with respect to the other axis of rotation Z provides the operator R with full rotational movement about all axes of rotation actuated by comfortable bending motion about the waist. In the illustrated embodiment, when the rings 40, 42, 44 are coplanar and the rider R is in an upright position, the third axis of rotation Z of the inner ring 40 is horizontal. The first and second axes of rotation X, Y are oblique with respect to this horizontal axis Z, but perpendicular to each other. Consequently, the oblique axes of rotation X, Y intersect the operator R in 90° relation to each other when the operator is in the initial starting position. This design enables the operator R to effect rotation about any of the several axes of rotation X, Y, Z with minimal effort.

To effect rotation about the horizontal axis Z, the rider R must produce force by leaning forward or backward to create a torque about this axis. The positioning of the handlebars 66 in front of the rider R out of the plane defined by the periphery of the inner ring 40 allows the rider R to pull or push with his arms to help effect rotation about the horizontal axis Z. Unlike the existing gyroscopes, however, simply by leaning forward and slightly to the left or right, the rider R can initiate rotation having a component about a vertical axis. Moreover, the rider R by selectively pushing or pulling the handlebars 66 at a slight angle to the vertical axis can produce greater torque about one of the oblique axis X, Y and effect rotation about that axis without unduly straining his or her body. The oblique orientation of the axes X and Y with respect to the height of the rider R places more of the mass of the rider's body at a distance from these axes so that a forward bending or rearward leaning motion produces substantial torque (and hence rotation) about these axes. It has been found that the rider R may change the direction of rotation from end-over-end about a horizontal axis Z to sideways about a vertical axis substantially instantaneously with a minimum of effort. Either a 180° rotation of the intermediate ring 42 relative to the frame 24 with the outer ring 44 remaining in an upright position, or a 180° rotation of the outer ring relative to the frame without rotation of the intermediate ring relative to the outer ring will place the rider sideways with rotation of the inner ring 40 about a vertical axis. The 180° rotation can be produced by either bending forward or leaning rearward and bending laterally at the rider's waist to one side or the other to produce rotation about either of the oblique axes X, Y. Moreover, the rider R can move the rings to produce a stiff-legged walking motion in which the rider remains upright with the sides of the rider's body alternately swinging forwardly and rearwardly. The ease of producing this walking motion is attributable to the orientation of the axes of rotation X, Y, Z Of the rings 40, 42, 44 which more readily permits rotation about a non-horizontal axis when the rider R is in an upright position.

After a period of use, the rider R can return to the initial position, either by the rider's manipulation with the assistance of the weights 64 mounted on the inner ring 40 or with the help of an attendant. When ready to dismount the gyroscope 20, the locking bar 76 is returned to the locked position, the belt 56 and the feet restraining straps 62 are released, and the rider R is able to leave the gyroscope.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A human-powered gyroscope comprising, a frame for supporting the gyroscope, a ring assembly comprising an inner ring, an intermediate ring and an outer ring concentrically disposed with each other, the outer ring being mounted on the frame for rotation relative to the frame about a first axis extending generally diametrically of the outer ring, the intermediate ring being mounted on the outer ring for rotation relative to the outer ring about a second axis extending generally diametrically of the intermediate ring, and the inner ring being mounted on the intermediate ring for rotation relative to the intermediate ring about a third axis of rotation extending generally diametrically of the inner ring, two of said axes of rotation being oriented obliquely with respect to the other of said axes of rotation, and means for supporting a human rider on the ring assembly.

2. A human-powered gyroscope as set forth in claim 1 wherein said first and second axes of rotation are oriented obliquely relative to the third axis of rotation.

3. A human-powered gyroscope as set forth in claim 2 wherein when the rings are generally coplanar and the rider is in an upright position, said third axis of rotation is oriented horizontally, and said first and second axes are oriented non-horizontally and non-vertically.

4. A human-powered gyroscope as set forth in claim 1 wherein two of said axes of rotation are oriented perpendicularly with respect to one another.

5. A human-powered gyroscope as set forth in claim 4 wherein said first and second axes of rotation are oriented perpendicularly with respect to one another.

6. A human-powered gyroscope as set forth in claim 1 wherein the frame supporting the gyroscope further comprises means for transporting the gyroscope.

7. A human-powered gyroscope as set forth in claim 6 wherein the transportation means comprises wheels removably attached to the frame of the gyroscope.

8. A human-powered gyroscope as set forth in claim 7 wherein the transportation means further comprises a hitch post attached to the frame of the gyroscope for connecting the gyroscope to a vehicle.

9. A human-powered gyroscope as set forth in claim 1 further comprising handlebars extending outwardly from the plane of the inner ring to a position forward of a rider supported on the ring assembly.

10. A human-powered gyroscope comprising, a frame for supporting the gyroscope, a ring assembly comprising an inner ring, an intermediate ring and an outer ring concentrically disposed with each other, the outer ring being mounted on the frame for rotation relative to the frame about a first axis extending generally diametrically of the outer ring, the intermediate ring being mounted on the outer ring for rotation relative to the outer ring about a second axis extending generally diametrically of the intermediate ring, and the inner ring being mounted on the intermediate ring for rotation relative to the intermediate ring about a third axis of rotation extending generally diametrically of the inner ring, and means for supporting a human rider on the ring assembly, the ring assembly being constructed and arranged such that when the rings are generally coplanar and the rider is in an upright position one of said axes of rotation is oriented generally horizontally, and the other axes of rotation are oriented non-horizontally and non-vertically.

11. A human-powered gyroscope as set forth in claim 10 wherein said first and second axes of rotation are oriented obliquely relative to the third axis of rotation.

12. A human-powered gyroscope as set forth in claim 10 wherein when the rings are generally coplanar and the rider is in an upright position, said third axis of rotation is oriented horizontally, and said first and second axes are oriented non-horizontally and non-vertically.

13. A human-powered gyroscope as set forth in claim 10 wherein two of said axes of rotation are oriented perpendicularly with respect to one another.

14. A human-powered gyroscope as set forth in claim 13 wherein said first and second axes of rotation are oriented perpendicularly with respect to one another.

15. A human-powered gyroscope as set forth in claim 10 wherein the frame supporting the gyroscope further comprises means for transporting the gyroscope.

16. A human-powered gyroscope as set forth in claim 15 wherein the transportation means comprises wheels removably attached to the frame of the gyroscope.

17. A human-powered gyroscope as set forth in claim 16 wherein the transportation means further comprises a hitch post attached to the frame of the gyroscope for connecting the gyroscope to a vehicle.

18. A human-powered gyroscope as set forth in claim 10 further comprising handlebars extending outwardly from the plane of the inner ring to a position forward of a rider supported on the ring assembly.

* * * * *